US006789987B2

(12) United States Patent
Langh

(10) Patent No.: US 6,789,987 B2
(45) Date of Patent: Sep. 14, 2004

(54) CARGO FREIGHT CONTAINER

(75) Inventor: Hans Langh, Piikkiö (FI)

(73) Assignee: Oy Langh Ship AB, Piikkio (FI)

( * ) Notice: Subject to any disclaimer, the term of this patent is extended or adjusted under 35 U.S.C. 154(b) by 0 days.

(21) Appl. No.: 10/289,412

(22) Filed: Nov. 7, 2002

(65) Prior Publication Data

US 2003/0106822 A1 Jun. 12, 2003

Related U.S. Application Data

(63) Continuation of application No. PCT/FI01/00478, filed on May 16, 2001.

(30) Foreign Application Priority Data

May 17, 2000 (FI) ..... 20001183
Jul. 24, 2000 (FI) ..... 20001704
Dec. 8, 2000 (FI) ..... 20002690

(51) Int. Cl.[7] ..... B60P 7/08

(52) U.S. Cl. ..... 410/49; 410/121; 410/130; 410/132; 410/141; 410/94; 410/150; 410/153

(58) Field of Search ..... 410/94, 121, 129–130, 410/132, 141, 143, 49, 144–145, 150, 153; 248/351, 354.6; 220/1.5

(56) References Cited

U.S. PATENT DOCUMENTS 1,665,439 A * 4/1928 Brown ..... 410/153
3,392,682 A * 7/1968 Francis ..... 410/42
4,986,706 A * 1/1991 Williams, Jr. ..... 410/129
5,509,764 A * 4/1996 Shives ..... 410/150
5,944,464 A * 8/1999 Cole, Jr. ..... 410/153
6,042,312 A * 3/2000 Durham, II ..... 410/143
6,068,433 A * 5/2000 Baloga ..... 410/145
6,231,284 B1 * 5/2001 Kordel ..... 410/49
6,514,022 B2 * 2/2003 Truckor et al. ..... 410/138

FOREIGN PATENT DOCUMENTS

| | | |
|---|---|---|
| DE | 24 29 715 | 1/1976 |
| DE | 43 35 478 | 4/1995 |
| DE | 299 09 725 U1 | 10/1999 |
| EP | 0 318 960 | 6/1989 |
| EP | 0 438 729 A2 | 7/1991 |
| WO | WO 92/20551 | 11/1992 |
| WO | WO 98/56614 | 12/1998 |
| WO | WO 99/52794 | 10/1999 |

* cited by examiner

*Primary Examiner*—Stephen Gordon
(74) *Attorney, Agent, or Firm*—Young & Thompson

(57) ABSTRACT

A cargo freight container has four walls (1*a* to 1*d*), a top (2) and a bottom (3), which form an interior having an inner ceiling (4) and an inner bottom (5). Between the inner ceiling (4) and the inner bottom (5) there is at least one load support (6), which is movable against goods (7) to be loaded in the container such that the goods (7) can be supported against the load support (6) at least in one direction.

20 Claims, 4 Drawing Sheets

CARGO FREIGHT CONTAINER

Figure 1:
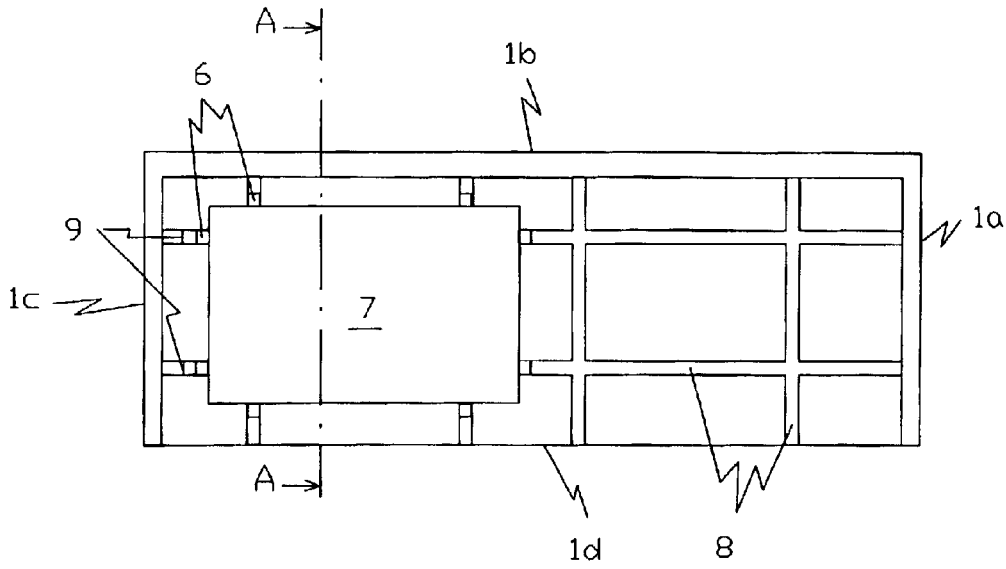

This application is a Continuation of International Application PCT/FI01/00478 filed 16 May 2001 which designated the U.S. and was published under Article 21(2) in English.

BACKGROUND OF THE INVENTION

The invention relates to a cargo freight container comprising four walls, a top and a bottom, which form an interior having an inner ceiling and an inner bottom.

In this context, the container refers to a sea container or a similar large transport receptacle, which is of the type intended for transporting goods e.g. by container carrier ship, train, truck or barge. Reference through-out this specification to a container is to be taken as a reference to a cargo freight container of the type as described above.

When heavy goods, such as metal plates and bullions, stacked timber plates and the like, are transported in containers, the goods should not move in the container during transport or storage, because the goods may damage the container, or the goods in the container may get damaged. The goods to be transported in one container may weigh e.g. 30 tons, whereby the total weight of the container and the goods is e.g. 35 tons.

If the goods are secured in the container in a manner that allows the goods to move even slightly during shipping as the ship rolls, this movement may become larger with time and eventually lead to uncontrollable movement of the goods with the above-described consequences. Therefore, it is very important to secure the goods such that they do not move in the container during transport and storage.

Various arrangements for securing the goods in the containers are previously known. An arrangement is known, in which heavy goods are transported in a container with a hard exterior, and packing material, such as timber, is placed between the inner wall and the goods. The goods are secured to the container with chains, for instance. This known arrangement has a drawback that it takes large amounts of timber to load the goods. If the volume of goods is small as compared with the volume of the container, considerable amounts of packing material are required. Another drawback with this known arrangement is that goods that are large in size with respect to the size of the container are difficult to secure in the container. The reason for this is that it is difficult for the loaders to get around the goods on all sides while loading, because there is little space between the inner wall of the container and the goods, for instance less than 0.5 m. This may lead to poor securing of goods, or the circumstances force to perform the securing poorly, because it is simply impossible to secure the goods to the container.

An arrangement is also known, in which heavy goods are transported on a flat, to which the heavy goods are secured. However, a flat of this kind does not protect the goods, and consequently the goods cannot be transported by this arrangement outside the cargo space of the ship. Recently, the protection of goods has become increasingly important, because the degree of processing of the metal plate blanks to be transported has increased, for instance.

BRIEF DESCRIPTION OF THE INVENTION

The object of the invention is to provide a cargo freight container, by which the above-described problems can be solved.

The objects of the invention are achieved by a cargo freight container, which is characterized by what is disclosed herein.

The preferred embodiments of the invention are also disclosed herein.

The container of the invention has an advantage that the load supports to be placed behind the goods can be pre-arranged/adjusted into place before the goods are loaded in the container. Hence, there is no need to go behind the goods for securing them to the container, the goods are simply put to place by pushing them against the load support by fork-lift truck.

The container of the invention has another advantage that it does not require any packing material, such as timber, for supporting the goods in the container. This saves material.

The container of the invention has yet another advantage that it enables firm securing of heavy goods in a container with a hard exterior.

List of Drawings

Figure 2:
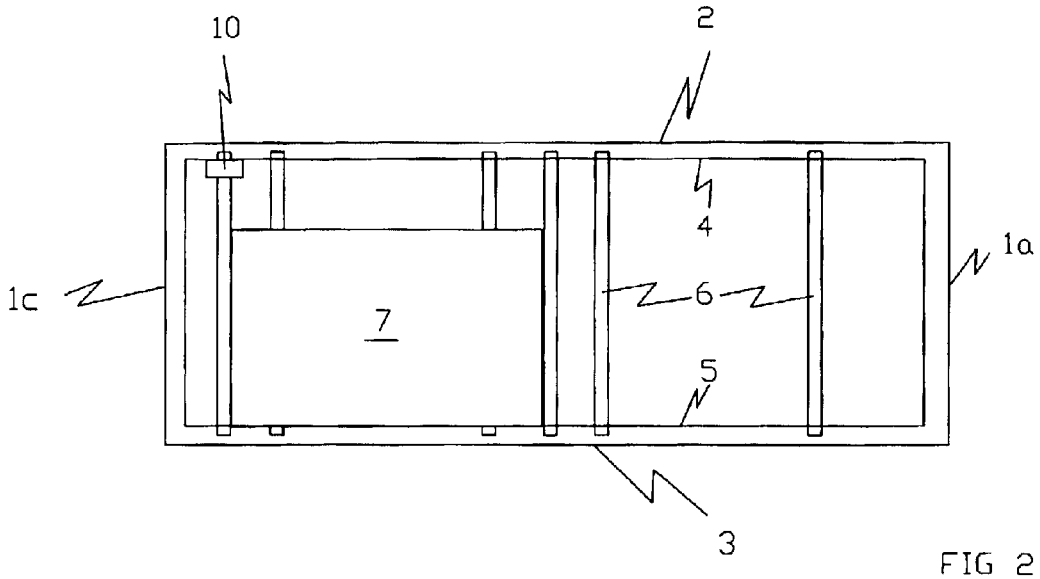
Figure 3:
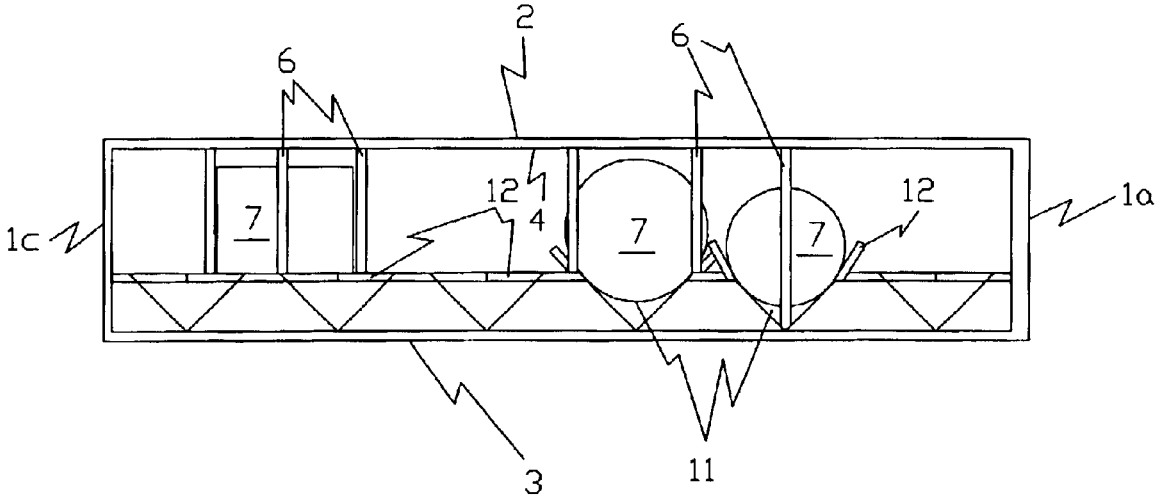
Figure 4:
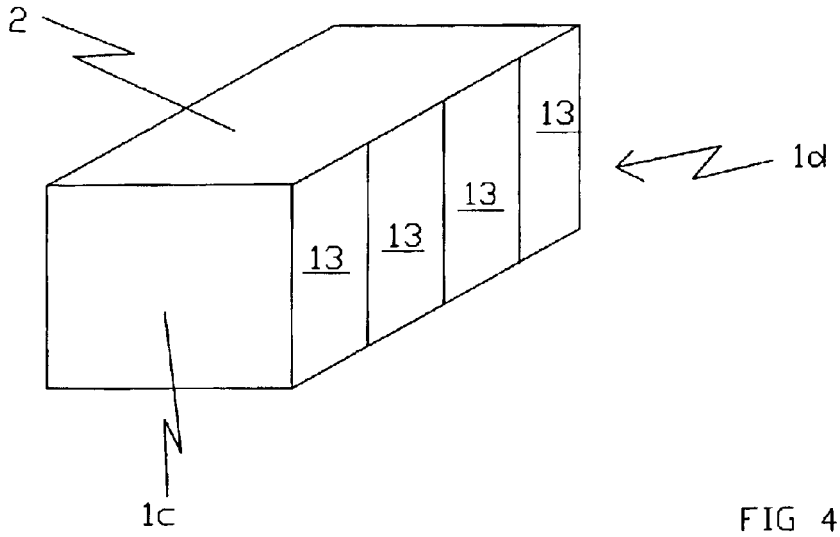
Figure 5:
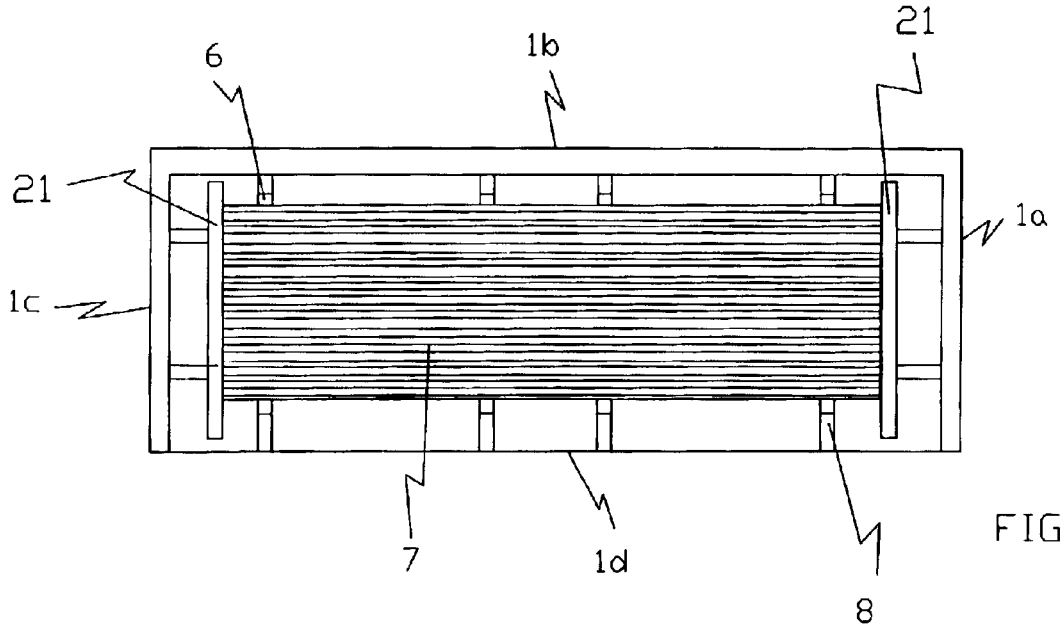
Figure 6:
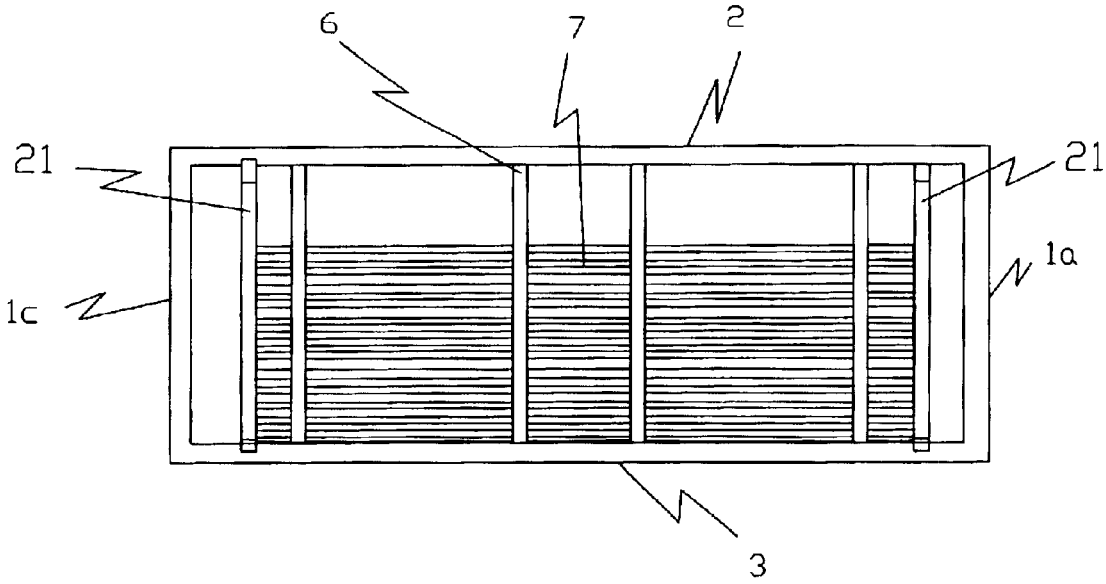
Figure 7:
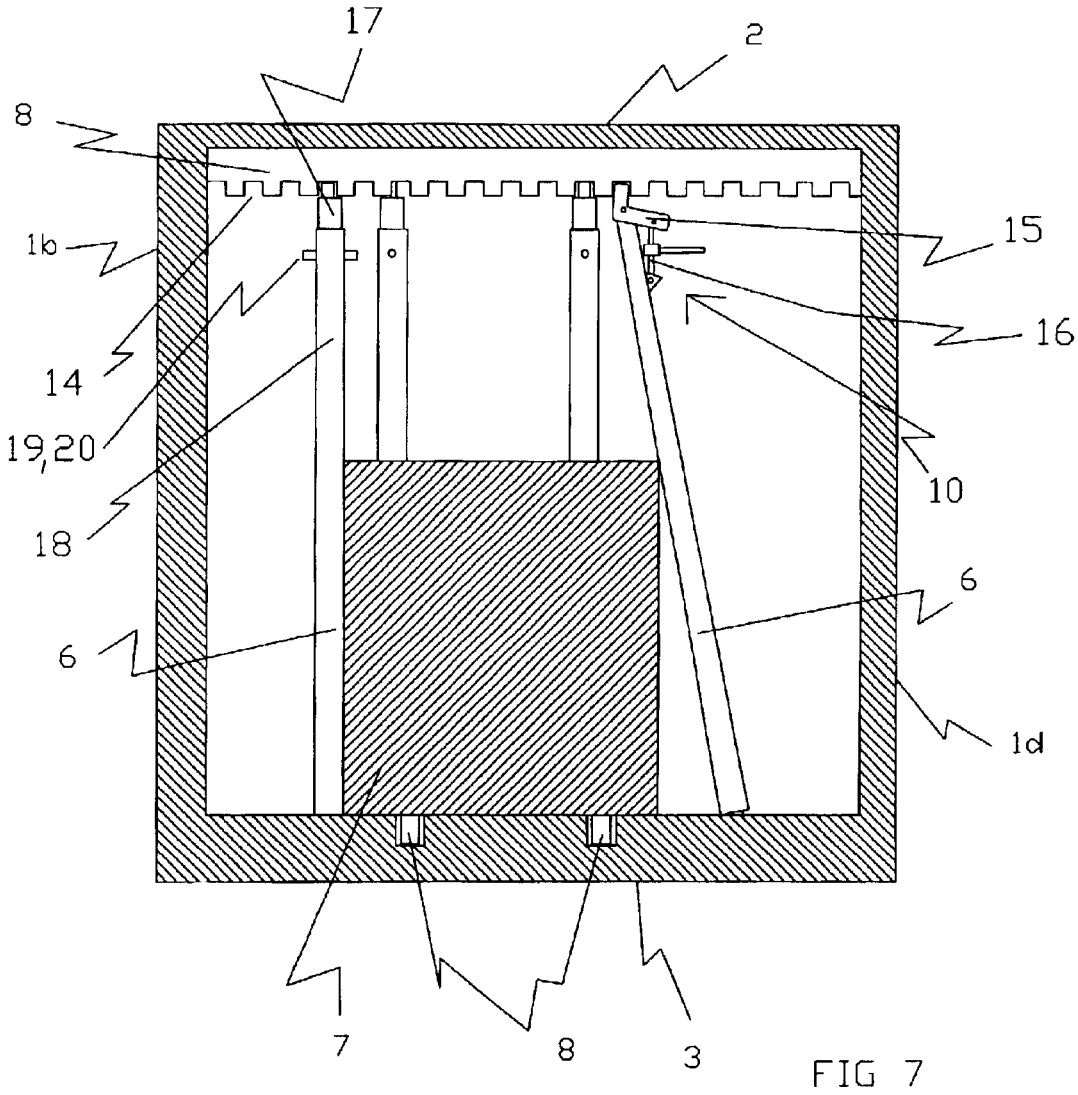

In the following, the invention will be described in greater detail in connection with the preferred embodiments, with reference to the attached drawings, wherein FIG. 1 is a top view of a container without a top and side doors, FIG. 2 is a side view of a container without side doors, FIG. 3 shows a container with recesses in the bottom for holding cylindrical goods in place in the container, FIG. 4 is a schematic view of a container., FIG. 5 is a top view of a container without a top and side doors, FIG. 6 is a side view of a container without side doors, and FIG. 7 is a sectional view of the container shown in FIG. 1 along line A—A.

DETAILED DESCRIPTION OF THE INVENTION

The figures show a container comprising four walls 1*a* to 1*d*, a top 2 and a bottom 3. The walls 1*a* to 1*d*, the top 2 and the bottom 3 together form an interior (not indicated by a reference numeral) having an inner ceiling 4 and an inner bottom 5. FIG. 4 show a container with four side doors 13. In the containers of the figures, the side doors 13 are arranged to open at least one of the four container walls, the wall 1*d* substantially completely. This makes loading and unloading of the container easier.

Between the inner ceiling 4 and the inner bottom 5 there is at least one load support 6, which is movable against goods 7 to be loaded in the container such that the goods 7 can be supported against the load support 6 at least in one direction. The load support 6 is thus at a distance from the inner walls (not indicated by a reference numeral) of the container.

More preferably the container comprises a plurality of load supports 6 as shown in the figures, the load supports 6 being movable onto at least two opposite sides of the goods 7 such that the goods are held in place between the opposing load supports 6. FIG. 1 shows a container, in which the goods 7 can be held in place on four sides (not indicated by a reference numeral) of the goods 7.

The figures show containers which comprise at least one rail 8 or the like, along which rail 8 the load supports 6 can be moved.

The containers of the figures comprise rails 8 in the inner ceiling 4 and rails 8 in the inner bottom 5. In FIG. 2, the rails 8 of the ceiling 4 and the rails 8 of the bottom 5 are substantially aligned so as to allow the load support 6 to be placed in a substantially vertical position between the inner ceiling 4 and the inner bottom 5.

In the figures, some of the rails 8 are substantially parallel with the walls 1*a* and 1*c*, and other rails 8 are substantially parallel with the walls 1*b* and 1*d* such that at least two rails 8 are substantially perpendicular to one another. Alternatively the container can be provided with rails 8 that are substantially parallel with any of the walls 1*a*–1*d* and such rails 8 that run in a direction deviating from a direction that is parallel with any of the walls 1*a*–1*d*. This allows load supports 6 to be moved in an easy way onto at least two opposite sides of the goods 7.

The container of the invention advantageously comprises at least one recess 11, a cradle or the like, for holding in place cylinder-shaped goods 7, such as reeled goods. FIG. 3 shows a container having six recesses 11 of this kind.

The recess 11, the cradle or the like, can advantageously be covered with at least one covering plate 12, or the like, such that it is possible to place goods 7 on the covering plate 11 or the like, when goods 7 requiring a flat base are to be transported in the container additionally or solely. FIG. 3 shows a container, in which each recess 11, cradle or the like, can be covered with a two-part covering plate 12.

The load support 6 can be advantageously supported to the covering plate 12 or the like when the covering plate covers the recess 11, the cradle or the like. The covering plates 12, or the like, advantageously comprise rails 8 (not shown in the figures). These rails advantageously run in the longitudinal direction of the container. This arrangement allows to hold reeled goods 7 in place in the longitudinal direction of the container.

The load support 6 can be advantageously placed in the recess 11 such that the load support 6 is between the bottom (not indicated by a reference numeral) of the recess 11 and the inner ceiling 4. An advantageous arrangement of this kind allows to prevent the reeled goods 7 from unwinding spirally from the reel centre (not indicated by a reference numeral). One load support 6 is advantageously placed on either side of the reeled goods 7 such that the load support 6 is located between the bottom of the recess 11 and the inner ceiling. The bottom of the recess 11 advantageously comprises a rail 8. The "ridges" (not indicated by reference numerals) between the recesses 11 advantageously comprise rails 8.

The container of the invention advantageously comprises an arrangement for locking the load support 6 with respect to the container (not indicated by a reference numeral). For instance, the rails 8 may comprise seats (not indicated by a reference numeral) for the load supports 6 with substantially even spacing. The load support 6 can be placed in these seats immovably with respect to the container. For instance, the rails 8 may comprise, with even spacing, iron bars 9 attached transversely thereto, recesses or the like, which prevent the load support 6 from moving along the rail 8. In FIG. 7, the upper rail 8 comprise recesses 14 with even spacing into which the upper end of the load support 6 can be placed.

The container of the invention advantageously comprises an arrangement 10 for pressing the load support 6 against the goods 7 such that the load support 6 leans against the goods 7. Said arrangement 10 for pressing the load supports 6 against the goods can be arranged to operate such that the load support 6 is first locked in place with said arrangement for locking the load support 6 with respect to the container, and thereafter, the load support 6 is pressed with said arrangement 10 for pressing the load supports 6 against the goods 7 such that it presses against the goods 7. It is particularly important that the upper end (not indicated by a reference numeral) of the goods 7 is not allowed to move. The lower end of the goods 7 will normally stay as placed, because the weight of the goods 7 holds it in place. Said arrangement 10 for pressing the load supports 6 against the goods 7 is advantageously arranged to shift the upper end of the load support 6 against the goods 7 such that the load support 6 leans at least against the upper part (not indicated by a reference numeral) of the goods 7. Said arrangement 10 for pressing the load supports 6 against the goods 7 comprises, for instance, a carriage (not indicated by a reference numeral), which is arranged to run in the rail 8 in the ceiling and wherein the upper end of the load support 6 can be placed. First the carriage can be advantageously locked to the rail 8 and thereafter the upper end of the load support 6 can be advantageously moved such that the load support 6 presses against the goods 7.

In FIG. 7 is shown an arrangement in which the upper rail is teethed so that it has a number of recesses 14 in which the upper end of the load support 6 can placed. After that the upper end of the load support has been placed in a particular recess 14, the upper end of the load support can be moved in the direction of the goods 7 so that the load support leans against the upper end of the goods 7 and the goods is pressed between two loads supports. In FIG. 7, said arrangement 10 for pressing the load supports 6 against the goods 7 comprise a threaded rod 16 which is arranged between the load support 6 and a locking device 15 which is adapted to be placed in a recess 14 in the upper rail 8. The locking device 15 is pivotably attached to the load support 6. By adjusting the angle (not indicated by a reference sign) between the load support 6 and the locking device 15, the total length of the load support 6 varies and the load support 6 moves against and away from the goods 7.

The figures show load supports 6 which consist of elongated poles. The load supports 6 are advantageously made of aluminium, for instance.

Some of the load supports 6 shown in FIG. 7 are telescopic such that it comprises two parts 17 and 18. The two parts of the load support are provided with holes 19 that operate together, into which holes a pin 20 can be inserted such that the parts are interlocked. The pin 20 comprises advantageously means (not shown) for locking the pin 20 in the hole 19.

In FIGS. 5 and 6 is shown a container in which some of the load supports are in the form of a movable wall 21 located at each end inside the container. With such movable walls 21, pipes or similar elongated goods can be pressed between the movable walls 21 and thus be held in place. The container in FIGS. 5 and 6 also comprises load supports 6 in the form of elongated poles. The container shown in FIGS. 5 and 6 comprises advantageously an arrangement (not shown) for locking the movable walls 21 in place in relation to the container. The container shown in FIGS. 5 and 6 comprises advantageously an arrangement (not shown) for pressing the movable wall 21 against the goods 7. Said arrangement can for example comprise straps (not shown) that are arranged between the movable walls 21 or one movable wall 21 and the container. By tensioning the straps, the movable walls can be moved towards the load and the load 7 will be pressed between the movable walls.

It is obvious to a person skilled in the art that as technology advances the basic idea of the invention can be implemented in a variety of ways. The invention and its embodiments are thus not restricted to the above-described examples but they may vary within the scope of the claims.

What is claimed is:

1. A cargo freight container comprising four walls, a top and a bottom, which form an interior having an inner ceiling and an inner bottom, wherein at least one load support is located between the inner ceiling and the inner bottom, the load support being movable against goods loaded in the container such that the goods can be supported at least in one direction against the load support, wherein the cargo freight container comprises an arrangement for locking the load support in the inner ceiling and the inner bottom with respect to the container, wherein the container comprises an arrangement for pressing the load support against the goods such that the load support presses against the goods, and wherein the arrangement for pressing the load support against the goods is arranged to operate such that the load support is first locked in place with said arrangement for locking the load support with respect to the container, and thereafter, the load support is pressed with said arrangement for pressing the load support against the goods such that said load support presses against the goods.

2. A cargo freight container as claimed in claim 1, comprising a plurality of load supports, which are movable onto at least two opposite sides of the goods such that the goods are held in place between the opposing load supports.

3. A cargo freight container as claimed in claim 1, comprising at least one rail said at least one load support being movable along the rail.

4. A cargo freight container as claimed in claim 3, comprising rails in the inner ceiling.

5. A cargo freight container as claimed in claim 4, comprising rails in the inner bottom.

6. A cargo freight container as claimed in claim 4, wherein the rails of the inner ceiling and the rails of the inner bottom are substantially aligned so as to allow the load support to be placed in a substantially vertical position between the inner ceiling and the inner bottom.

7. A cargo freight container as claimed in claim 3, wherein said at least one rail is substantially parallel with one side of the container.

8. A cargo freight container comprising four walls, a top and a bottom, which form an interior having an inner ceiling and an inner bottom, wherein at least one load support is located between the inner ceiling and the inner bottom, the load support being movable against goods loaded in the container such that the goods can be supported at least in one direction against the load support, wherein the cargo freight container comprises an arrangement for locking the load support with respect to the container, wherein the container comprises an arrangement for pressing the load support against the goods such that the load support presses against the goods, wherein the arrangement for pressing the load support against the goods is arranged to operate such that the load support is first locked in place with said arrangement for locking the load s support with respect to the container, and thereafter, the load support is pressed with said arrangement for pressing the load support against the goods such that said load support presses against the goods, and wherein the container comprises at least two rails, said at least one load support being movable along at least one of said two rails, at least one of said two rails being substantially parallel with one side of the container, at least two of said rails being substantially perpendicular to one another.

9. A cargo freight container as claimed in claim 1, comprising at least one recess or cradle for holding in place cylindrical goods.

10. A cargo freight container as claimed in claim 9, wherein the recess or the cradle can be covered with at least one covering plate such that goods can be placed on the covering plate.

11. A cargo freight container as claimed in claim 10, wherein the load support is supported by the covering plate when the covering plate covers the recess or cradle.

12. A cargo freight container as claimed in claim 11 wherein the covering plate comprises rails.

13. A cargo freight container as claimed in claim 9, wherein the load support can be placed in the recess such that the load support is between the bottom of the recess and the inner ceiling.

14. A cargo freight container as claimed in claim 13, wherein a rail is in the bottom of the recess.

15. A cargo freight container as claimed in claim 1, wherein the load support is an elongated pole.

16. A cargo freight container as claimed in claim 1, wherein the load support is a movable wall.

17. A cargo freight container as claimed in claim 3, comprising rails in the inner bottom.

18. A cargo freight container, comprising:

four walls, a top and a bottom, which form an interior having an inner ceiling and an inner bottom;

at least one movable strut located between the inner ceiling and the inner bottom;

at least one member that adjustably fastens the strut against goods loaded in the container; and an adjustable pressing device that presses a surface of the strut against the goods with an adjustable pressure.

19. The cargo freight container as claimed in claim 18, wherein the pressing device is pivotably connected to said strut.

20. The cargo freight container as claimed in claim 18, wherein the adjustable pressing device presses the strut with a first pressure when the strut contacts the goods and an increased second pressure that maintains the goods in position when the strut is fastened against the goods.

* * * * *